United States Patent [19]

Thomson et al.

[11] 4,091,492

[45] May 30, 1978

[54] CLEANING DEVICE FOR CONVEYOR SYSTEM RAIL

[75] Inventors: Ronald E. Thomson, Cambridge; James F. Schmitt, Marshall, both of Wis.

[73] Assignee: Madison-Kipp Corporation, Madison, Wis.

[21] Appl. No.: 763,044

[22] Filed: Jan. 27, 1977

[51] Int. Cl.[2] ..... E01H 8/12; A46B 15/00

[52] U.S. Cl. ..... 15/246; 15/21 R; 15/77

[58] Field of Search ..... 15/21 R, 21 E, 4, 77, 15/88, 54, 55, 246; 104/279; 198/496; 118/72

[56] References Cited

U.S. PATENT DOCUMENTS

| | | | |
|---|---|---|---|
| 3,641,618 | 2/1972 | Rainey et al. | 15/77 X |
| 3,806,979 | 4/1974 | Bonami | 15/21 R |
| 3,935,610 | 2/1976 | Vogt | 15/21 R |

*Primary Examiner*—Edward L. Roberts

*Attorney, Agent, or Firm*—Merriam, Marshall & Bicknell

[57] ABSTRACT

A cleaning device for a rail over which a conveyor or trolley system runs. The device comprises a pair of biased arm members, each arm member having a plurality of brush assemblies adapted to contact various portions of the conveyor rail.

4 Claims, 4 Drawing Figures

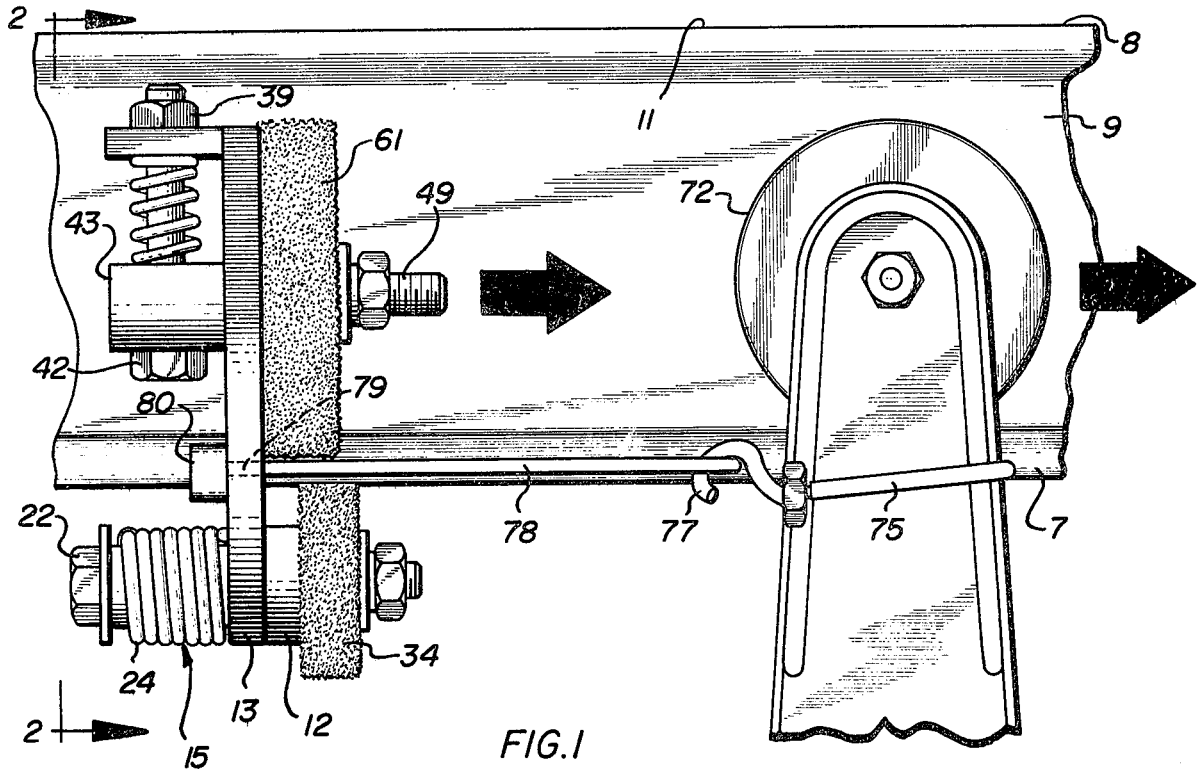
FIG.1
FIG.2
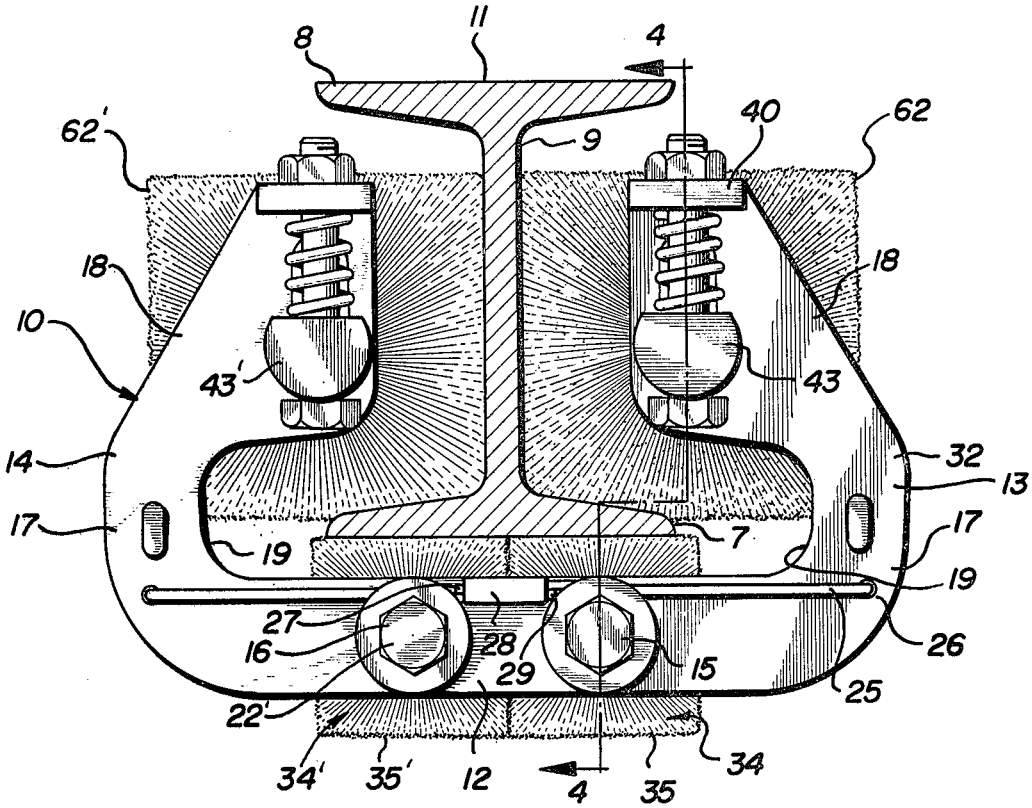

CLEANING DEVICE FOR CONVEYOR SYSTEM RAIL

This invention relates to a device for cleaning rails upon which a conveyor means is adapted to travel and more particularly to a brush type cleaning device adapted to be pulled over a track upon which a conveyor is adapted to run whereby the brushes of the cleaning device serve to remove dirt, dust and other foreign material from the track.

BACKGROUND OF THE INVENTION

In the manufacture and assembly of goods, overhead conveyor or trolley systems are often utilized for moving production articles or components from one work station to another. In most instances, as for example where a part is to be painted, it is important that foreign particles or materials such as dirt or dust not contact the part. Unfortunately, it has been found that with overhead conveyor systems employed to transport parts, undesired foreign substances fall and rest upon the rail or track upon which the trolley wheels of the conveyor system travel. Over a period of time a substantial amount of dirt accumulates on the rail. Subsequently, when a trolley wheel passes over the deposited dirt, the dirt is extruded by the weight of the trolley or conveyor wheel and compressed into larger particles which drop off the rail. The particles often drop onto the work stations located below the rail or onto the product or part upon which some operation such as painting is to be performed.

In order to eliminate this problem, it is necessary in some cases to stop the conveyor line while the trolley and rail or track are cleaned. This cleaning operation is unsatisfactory because it involves a significant amount of time and labor. Further, the cleaning must often be accomplished at a time when the conveyor system is not in operation, resulting in a loss of production.

Another method employed to obviate the problem of dirt accumulation on the trolley track has been to place catch pans below the conveyor system to catch foreign particles which drop off the rail. This solution has not been uniformly satisfactory, inasmuch as it remains necessary to periodically remove any material accumulated in the catch pans, generally by means of a vacuum cleaner system.

In other applications, the use of catch pans is not a feasible solution due to the location of the conveyor system in a particular facility and the difficulty associated with placing catch pans in proper position. What is desired is a device which precludes particle build-up on a rail or track of a conveyor system, thereby minimizing the problem of extruded dirt particles falling onto work stations or parts being manufactured or assembled.

SUMMARY OF THE INVENTION

With the view of obviating the problem of foreign particles dropping off an overhead conveyor system as heretofore described, the invention disclosed and claimed herein relates to a cleaning device which is adapted to be connected to and travel with an overhead conveyor system. The device comprises a plurality of brush means which are attached to a pair of biased arm members whereby the brushes contact a conveyor track and serve to maintain the track free of build-up of foreign particles. The prevention of dirt build-up on the track serves to minimize the problem of dirt extrusion, inasmuch as there is not a sufficient amount of dirt to be extruded from the rail by a trolley wheel.

The device of the present invention is attached to the conveyor system and will operate as long as the conveyor system is in operation. Once the device is positioned in place on a track and attached to and adjusted relative to the conveyor track, further adjustment is not required. The need for catch pans is also obviated in many instances, inasmuch as dirt build-up is precluded by the cleaning device which constantly cleans the rail as it travels with the conveyor system.

BRIEF DESCRIPTION OF THE DRAWINGS

The invention will be better understood from the following detailed description thereof, taken in conjunction with the accompanying drawings, wherein:

FIG. 1 shows a side view of the cleaning device of the present invention installed on a conveyor rail with the device being attached to a trolley wheel bracket;

FIG. 2 shows an end section view of the cleaning device of FIG. 1 taken along lines 2—2 in FIG. 1;

DETAILED DESCRIPTION

Figure 3:
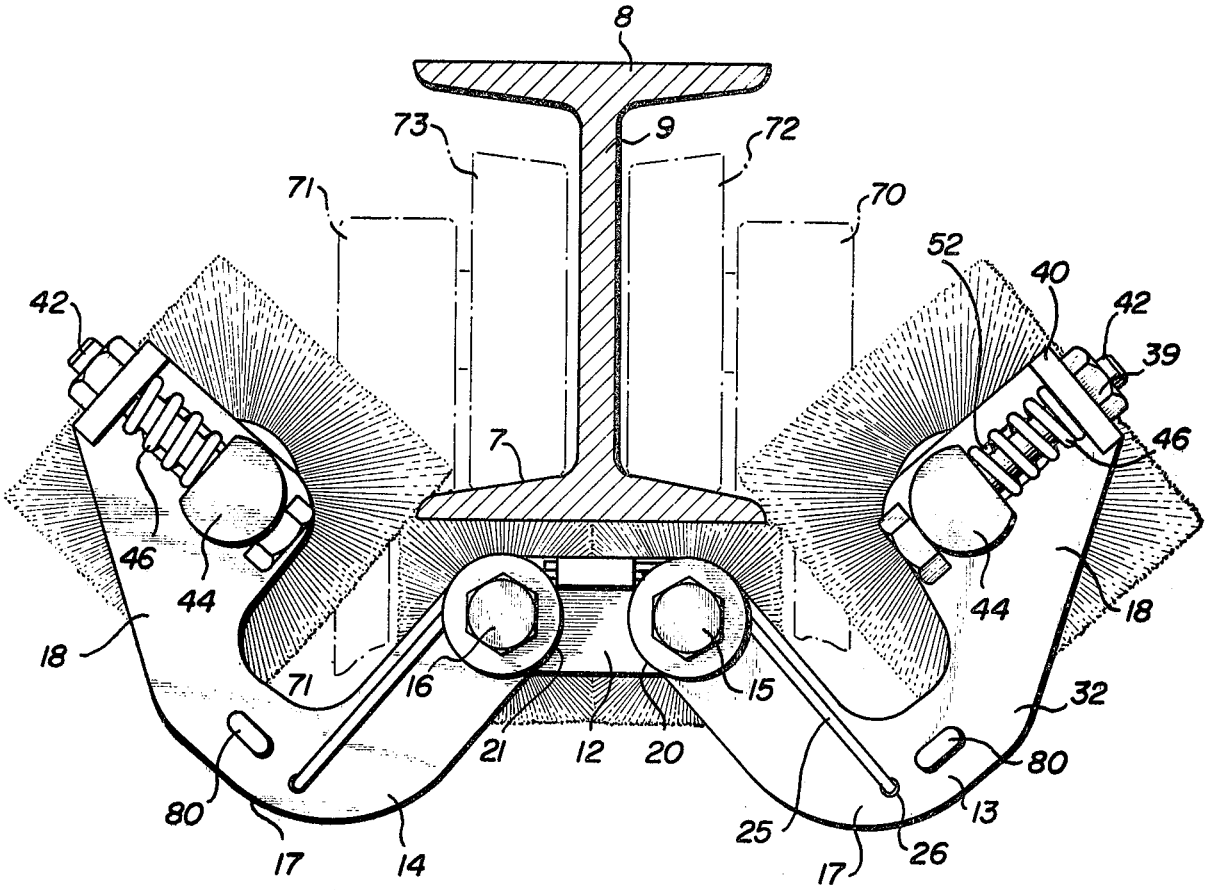
FIG. 3 shows the cleaning device of the present invention as seen in FIG. 2, with the exception that the biased arm members are in opened, inoperative position relative to the I-beam conveyor rail; and, FIG. 4 shows a section view of the cleaning device of the present invention taken along lines 4—4 in FIG. 2.

Referring to the drawings, cleaning device 10 of the present invention is adapted to travel on conveyor rail 11 which is illustrated as an I-beam comprising vertical section 9, top flange 8 and bottom flange 7.

Device 10 includes mounting plate 12. First and second arm members 13, 14 are fastened to plate 12 by means of brush mounting assemblies 15, 16. Each of arm members 13, 14 comprises a U-shaped section 17 and a brush mounting holder position 18. The hollow 19 of the U-shaped section permits the arm member to be positioned relative to flange 7 without contacting the flange.

First arm member 13 is attached to mounting plate 12 at end 20 while second arm member 14 is attached to plate 12 at arm member end 21.

Brush mounting assembly 15 includes bolt 22 which passes through bore 23 in arm member 13. Torsion spring 24 is positioned on bolt 22 with one end 25 of spring 24 located in bore 26 on arm member 13. The remaining end 27 of spring 24 is attached by any suitable means such as crimping material 28 to a corresponding spring end 29 of a torsion spring located on bolt 22' of brush mounting assembly 16. Torsion spring 24 is positioned on sleeve 30. One end of sleeve 30 abuts washer 31 while the remaining sleeve end abuts wall 32 of arm member 13.

Bolt 22 also passes through bore 33 in mounting plate 12. Brush assembly 34 having brushes 35 which are adapted to contact the bottom of rail flange 7 is positioned on bolt 22. Washers 36, 37, lock washer 38 and nut 39 complete brush mounting assembly 15.

The structure of brush mounting assembly 16 corresponds to the structure described for brush mounting assembly 15 so that a pair of brush assemblies 34, 34' having brushes 35, 35' are positioned below and in contact with flange 7 of rail 11.

Figure 4:
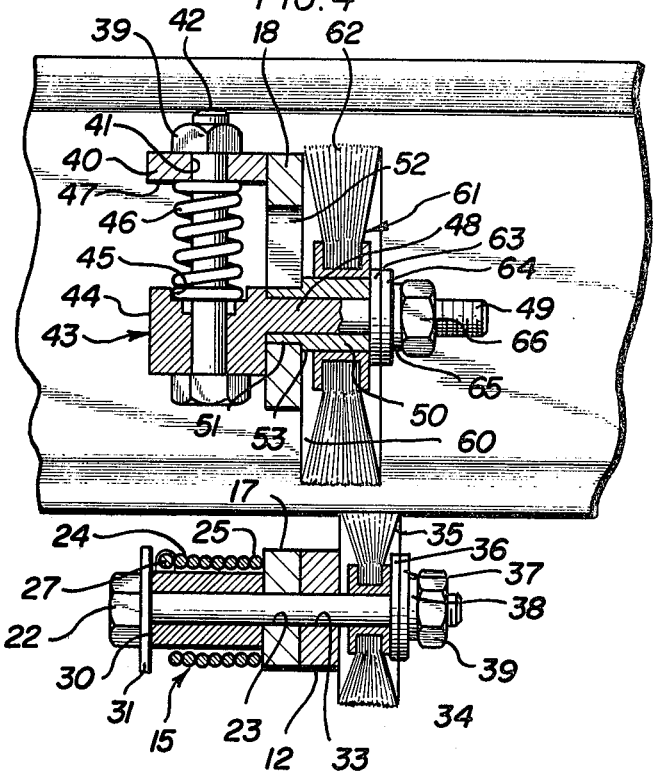

Referring to the mounting holder portions of the members 13, 14, holder portion 18 of arm 13 includes lug 40 which extends outwardly from wall 32 of arm members 13. As seen in FIG. 4, lug 40 has a bore 41 through which mounting bolt 42, which is connected to brush mounting assembly 43, passes.

As seen in FIG. 4, brush mounting assembly 43 includes spring seat member 44, which has a recess 45, in which compression spring 46 is seated. Spring 46 is positioned on mounting bolt 42 and abuts bottom wall 47 of lug 40.

Spring seat member 44 includes shaft 48 threaded at shaft end 49. Sleeve 50 is positioned on shaft 48, which comprises a first portion 51 and a shoulder portion 53. Portion 51 is disposed in slot 52 located in portion 18 of arm member 13. The outer diameter of portion 51 is less than the width of slot 52 while the outer diameter of shoulder portion 53 is greater than the width of slot 52 whereby sleeve 50 will, upon assembly, abut wall 60 of portion 18.

Brush assembly 61 having brushes 62 fits on shoulder portion 53. Washers 63, 64, lock washer 65 and nut 66 complete the brush mounting assembly 43. Brushes 62 contact wall 60 of portion 18 of arm member 13. If desired, appropriate washer means could be employed on shoulder portion 53 to space brush assembly 61 relative to wall 60.

The brush mounting assembly 43 is fastened to lug 40 by means of bolt 42 and nut 39. Assembly 43 can be positioned relative to lug 40 by tightening or loosening nut 39 on bolt 42. When nut 39 is tightened on bolt 42, assembly 43 will move toward lug 40 while spring seat member 44 moves upward in slot 52 and brush assembly 61 will move away from flange 7 of rail 11.

As shown in the drawings, arm member 14 has a brush mounting assembly 43', attached to it which corresponds in structure to the structure previously described for mounting assembly 43 attached to arm member 13. Mounting assembly 43' on arm member 14 includes brushes 62' adapted to contact one side of vertical section 9 and a portion of the top wall of flange 7. Brushes 62 on mounting assembly 43 located on arm 13 contact the remaining side of vertical section 9 and the remaining portion of the top wall of flange 7.

A portion of a trolley bracket and trolley or conveyor wheels employed in a conveyor system adapted to travel on I-beam rail 11 is illustrated in FIGS. 1 and 3. Trolley brackets 70, 71 are connected to trolley wheels 72, 73 which are adapted to travel on top wall of flange section 7 of I-beam rail 11.

Attached to each of brackets 70, 71 is a connector member 75 which can be fastened to the brackets by any suitable means which would be obvious to one skilled in the art such as a spot weld or a releasable fastening means. Connector 75 has a U-shaped hook 77 extending from one end of connector 75. Hook 77 is adapted to connect to a looped cable 78. Looped cable 78 extends from each of arm members 13, 14. Each end of cable 78 is passed through bore 79 and the ends are spliced together by a splicing sleeve 80.

Upon actuation of the conveyor system and movement of the trolley wheels 72, 73 on rail 11, cleaning device 10 and brushes 35, 35', 62, 62' are pulled along the rail in the course of which the brushes will clean the rail and thereby preclude dirt build-up on conveyor rail 11.

When it is necessary to either remove or install device 10 on rail 11, arm members 13 and 14 can be biased to an inoperative position as shown in FIG. 3 and the device can be moved relative to rail 11. Torsion springs 24 on the assemblies 43, 43' normally urge the arm members toward each other and rail 11.

Adjustment of compression spring 46 by loosening or tightening of nut 39 moves spring seat member 44 and brush assembly 61 relative to lug 40 and the rail to be cleaned until brushes 62, 62' are positioned at a desired location for a cleaning operation.

While loop cable 78 has been illustrated as being attached to hook 77 of connector 75, hook 77 and connector member 75 could be eliminated and cable 78 could be looped over the trolley wheels and around the trolley brackets so that the cable is not be damaged by any moving components. Similarly, other arrangements other than a looped cable could be utilized. If desired, a single piece of cable material having a hook engaging means at the outboard end thereof could be employed.

While various brushes can be employed with the cleaning device of the present invention, it has been found that for one application square brush assemblies 62, 62' are each 2¼ inch square and have .010 inch diameter metal wire brushes. These assemblies are available from Milwaukee Brush Co., 2236 N. 30th Street, Milwaukee, Wisconsin. Brush assemblies 43, 43' also available from Milwaukee Brush Co., each comprise 0.010 inch diameter metal wire brushes and are 1¼ inch square brush assemblies.

Torsion springs 24 are available from Associated Spring Corporation, 18 Main Street, Bristol, Connecticut and bear Associated catalog number T078-360-578 L-S and T078-360-578 R-S. Springs 46 also are available from Associated Spring Corporation and bear Associated catalog no. 0420-051-1000-S.

Looped cable 78 comprising a 1/16 inch diameter coated aircraft cable has been found satisfactory for the device shown and claimed herein and is available from McMasters Carr Supply Company, P.O. Box 4355, Chicago, Illinois, and bears catalog number 3686W1. Splice sleeves 80 for splicing the ends of cable 78 are made of copper and are also available from McMasters Carr as catalog number 3506T12.

It is appreciated that cleaning device 10 of the present invention could be made from any suitable materials and depending upon the application, the brushes could be of any desired size and stiffness. Additionally, depending upon a particular application, the various parts of the rail cleaning device of the present invention could be of different size.

The foregoing detailed description has been given for clearness of understanding only and no unnecessary limitations should be understood therefrom, as modifications will be obvious to those skilled in the art.

What is claimed is:

1. A device for removing foreign particles from a rail member comprising a vertical section having side walls and an integral bottom flange having top and bottom surfaces and upon which a trolley means is adapted to travel, said device comprising:

a plate member having two ends;

a pair of arm members, each of which is pivotally connected to an end of said plate member;

each of said arm members comprising a U-shaped section and a brush mounting holder portion having a lug extending from a wall of said portion;

a first pair of brush assemblies including corresponding brushes adapted to contact the sides of said rail member, each of said first brush assemblies being connected to the lug of a corresponding one of said arm members;

spring means for biasing said arm members relative to said rail such that said first brush assembly brushes contact said side walls of said rail member, said bottom flange of said rail member being adapted to be disposed in the area of the hollow of each of said U-shaped sections;

a second brush assembly mounted to said plate member and having brushes adapted to contact the bottom surface of said rail member bottom flange; and means for connecting said device to a trolley means adapted to travel on said rail member.

2. A device in accordance with claim 1 wherein each of said first brush assemblies includes means comprising a spring for simultaneously biasing said first brush assembly brushes against the top surface of said rail member bottom flange and said second brush assembly brushes against the bottom surface of said rail member bottom flange.

3. A device in accordance with claim 1 wherein said connecting means includes at least one cable attached to said device and is adapted to be connected to a trolley means whereby said device is pulled along a rail when said trolley means moves along said rail.

4. A device in accordance with claim 3 wherein said cable connecting means is fastened to each of said arm members and each is a looped cable adapted to be connected to a trolley means.

* * * * *